US006149004A

United States Patent [19]

Lapinski

[11] Patent Number: 6,149,004

[45] Date of Patent: Nov. 21, 2000

[54] PACKAGING SYSTEM UTILIZING A PLASTIC TRAY

[75] Inventor: Richard A. Lapinski, Augusta, Mich.

[73] Assignee: W. K. Kellogg Institute, Battle Creek, Mich.

[21] Appl. No.: 09/395,672

[22] Filed: Sep. 14, 1999

Related U.S. Application Data

[60] Provisional application No. 60/100,891, Sep. 23, 1998.

[51] Int. Cl.[7] ..... B65D 21/00

[52] U.S. Cl. ..... 206/499; 206/386

[58] Field of Search ..... 206/499, 503, 206/504, 203, 557, 561, 386, 600, 597, 821; 220/4.26, 529, 532, 533

[56] References Cited

U.S. PATENT DOCUMENTS

| | | | |
|---|---|---|---|
| 2,534,010 | 12/1950 | Frye . | |
| 2,534,011 | 12/1950 | Frye . | |
| 2,620,117 | 12/1952 | Nemoede . | |
| 2,700,521 | 1/1955 | Lapham . | |
| 2,851,188 | 9/1958 | Pavelle | 206/499 |
| 2,874,834 | 2/1959 | Woodward | 206/499 |
| 2,968,397 | 1/1961 | Cantrell, Sr. | 206/499 |
| 3,495,705 | 2/1970 | Limbacher . | |
| 3,554,429 | 1/1971 | Cohen . | |
| 3,636,888 | 1/1972 | Angelbeck, Jr. . | |
| 3,749,299 | 7/1973 | Ingle . | |
| 3,799,382 | 3/1974 | Munroe . | |
| 4,516,677 | 5/1985 | Rowland et al. . | |
| 4,550,830 | 11/1985 | Shuert . | |
| 4,643,314 | 2/1987 | Kidd . | |
| 4,776,481 | 10/1988 | Kidd . | |
| 4,877,137 | 10/1989 | Govang et al. | 206/597 |
| 5,029,734 | 7/1991 | Nichols . | |
| 5,092,525 | 3/1992 | Gillhart . | |
| 5,251,753 | 10/1993 | Pigott et al. | 206/386 |
| 5,310,063 | 5/1994 | Skolasinski . | |
| 5,487,471 | 1/1996 | Marchek et al. | 206/386 |
| 5,525,030 | 6/1996 | Buchman . | |
| 5,547,081 | 8/1996 | Mullock et al. . | |

OTHER PUBLICATIONS

TriEnda Corporation Custom Twin–Sheet Thermoforming Brochure.

*Primary Examiner*—Paul T. Sewell
*Assistant Examiner*—Luan K. Bui
*Attorney, Agent, or Firm*—Howard & Howard

[57] ABSTRACT

The present invention comprises a container assembly having a plurality of layers of containers. Each container includes a first tray and a second tray, which function as a bottom and a top respectively and which are shaped identically. The container further includes a shroud located between the first and second tray and a plurality of dividers located within the shroud. A plurality of containers are stacked on each other, and when so stacked the second tray of a first container functions as the first tray of a second container placed on top of the first container.

17 Claims, 7 Drawing Sheets

Fig-5
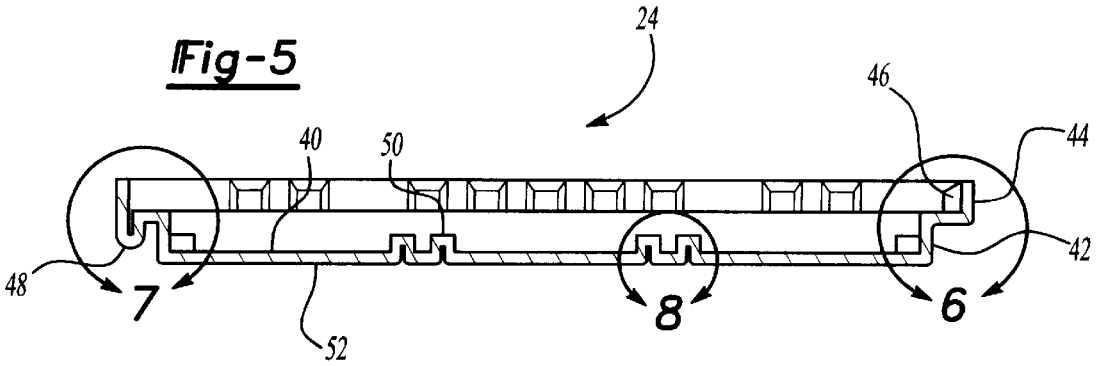
Fig-6
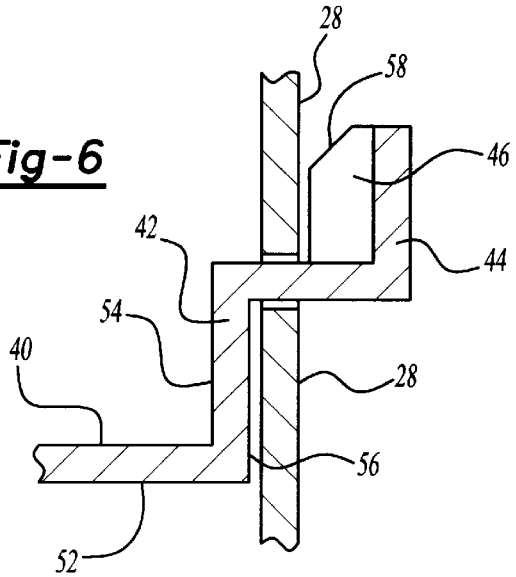
Fig-7
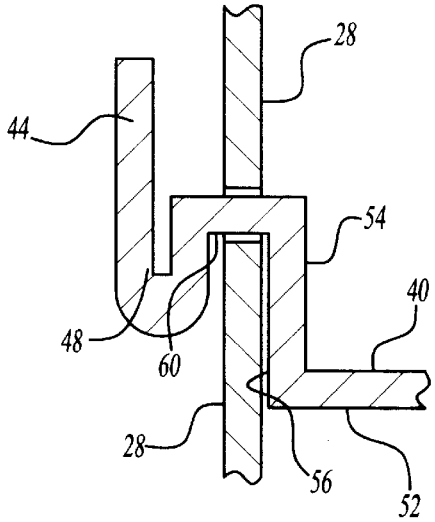
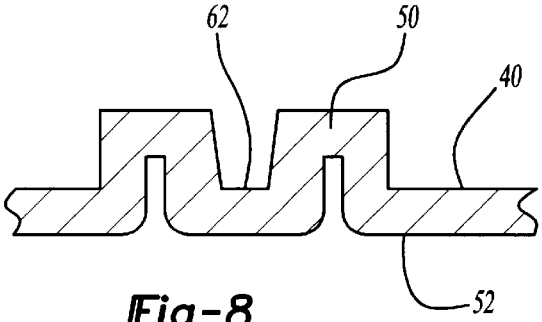
Fig-8
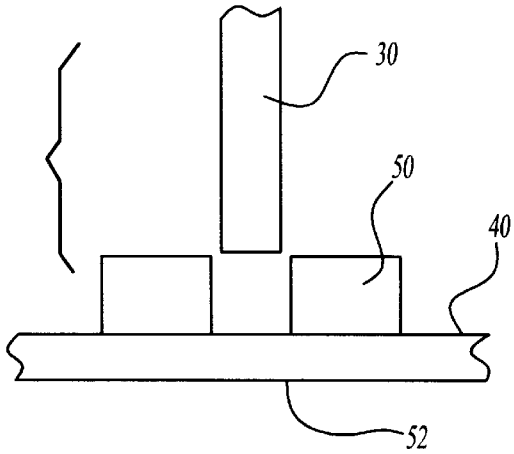
Fig-9

PACKAGING SYSTEM UTILIZING A PLASTIC TRAY

This application claims the benefit of U.S. Provisional Application Ser. No. 60/100,891, filed Sep. 23, 1998.

BACKGROUND OF THE INVENTION

This invention relates generally to a packaging system and, more particularly, to a packaging system that utilizes a tray that is able to simultaneously serve as a top of a first container and a bottom of a second container. In addition, the tray can serve as either a top or a bottom of a single container.

One disadvantage with current packaging systems is the number of components used to create an effective packaging system. The large number of components increases the cost of manufacturing the packaging and the cost of shipping the packaging. In addition, a new emphasis is being placed on designing packaging having a flexible design that is able to contain a variety of sizes and counts of consumer goods and that can be reused multiple times in a distribution system.

Thus, it is advantageous to design a packaging system having a reduced number of packaging components while retaining sufficient strength in the packaging to protect the goods. One way to accomplish this is to design packaging wherein a single component can perform several functions in the packaging system and wherein the packaging system can accommodate materials having a variety of sizes, shapes, and packaging counts. It is also desirable to reduce the weight of the packaging material to reduce the cost of transportation. In addition, it is desirable that the light weight packaging be reusable and collapsible to a smaller size for return shipping.

The present invention provides a reusable, lower cost, high strength packaging system having a reduced number of components and wherein several functions are performed by a single component. The present invention also eliminates the need for tier sheets when it is used as a unit on a plastic pallet with a locking top cap.

SUMMARY OF THE INVENTION

In general terms, this invention provides a packaging system having a reduced cost and number of components that retains the strength of previous systems.

The present invention comprises a container assembly comprised of a plurality of containers arranged in layers. In a first layer each container includes a first tray and a second tray with a shroud retained between the first tray and the second tray. The first tray has a shape that is identical to the shape of the second tray. The first tray functions as a bottom of the container while the second tray functions as a top of the container. A plurality of dividers are arranged within the shroud. A second layer of containers are placed on top of first layer. When the second layer of containers is placed on the first layer, the second tray of a container in the first layer functions as a bottom for a container in the second layer.

Each tray includes a first surface surrounded by a raised peripheral rim and an outer wall mounted on the peripheral rim. The outer wall includes a plurality of inwardly projecting ribs and a plurality of tabs extending downwardly from the outer wall. A notch is formed between the tabs and an outer surface of the peripheral rim. Each tray also includes a second surface opposite the first surface. A shroud is retained adjacent the first surface by the ribs and a shroud is retained adjacent the second surface in the notch. A plurality of pairs of retaining members project upwardly from the first surface and hold the dividers in place on first surface within the shroud.

These and other features and advantages of this invention will become more apparent to those skilled in the art from the following detailed description of the presently preferred embodiment. The drawings that accompany the detailed description can be described as follows.

BRIEF DESCRIPTION OF THE DRAWINGS

FIG. 5 is a partial cross-sectional view along line 5—5 of FIGS. 4A and B;

FIG. 6 is an enlarged view of circle A from FIG. 5;

FIG. 7 is an enlarged view of circle B from FIG. 5;

FIG. 8 is an enlarged view of circle C from FIG. 5;

FIG. 9 is an enlarged view of a divider inserted between a pair of retaining members.

DETAILED DESCRIPTION OF THE PREFERRED EMBODIMENT

Figure 1:
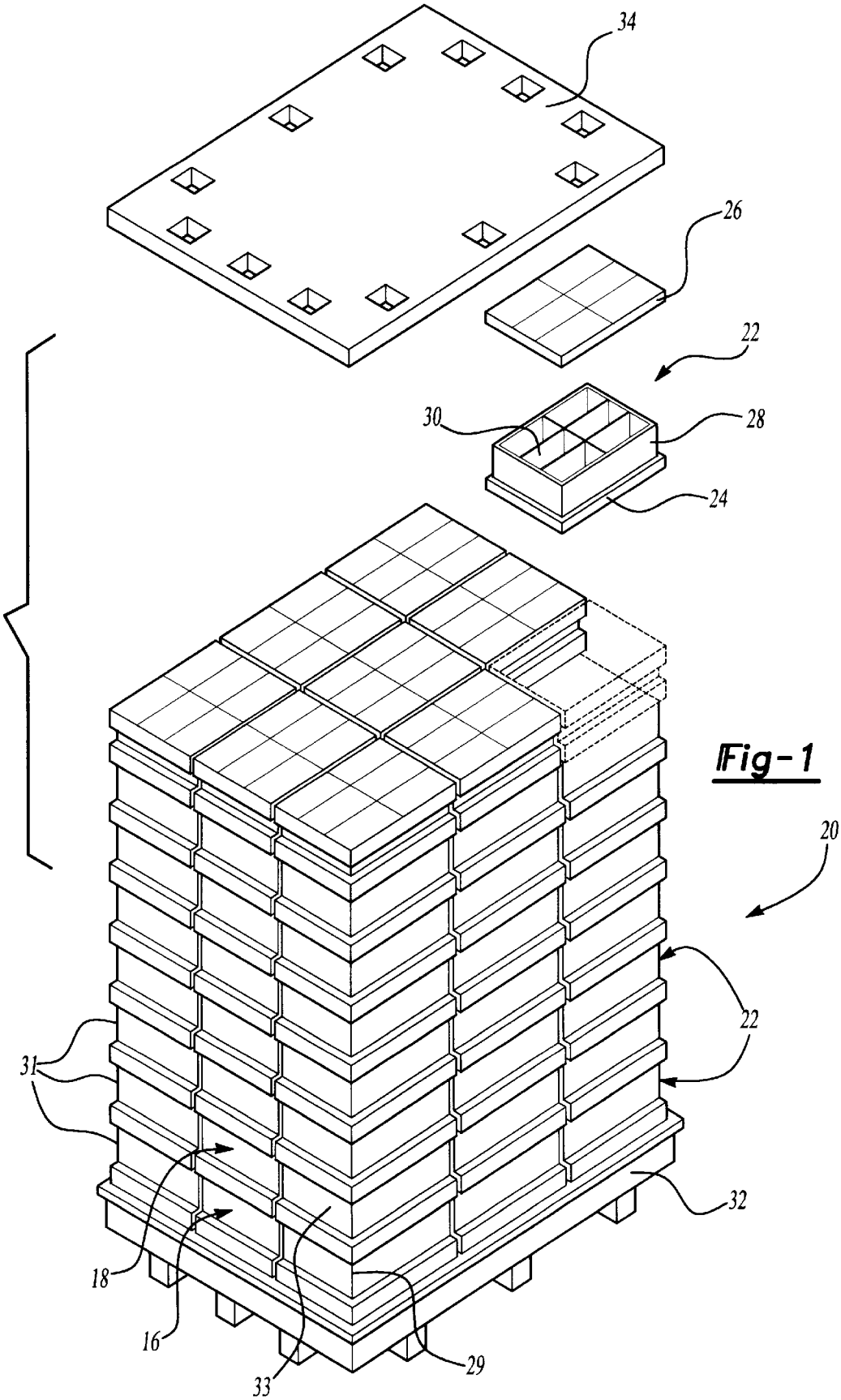
FIG. 1 is a side perspective view of a container assembly designed according to the present invention.

A container assembly is generally indicated at 20 in FIG. 1. Container assembly 20 includes a plurality of layers 31 including a first layer 16 and a second layer 18. Each layer 31 includes a plurality of containers 22, including a first container 29 and a second container 33. Each container 22 includes a first tray 24, a second tray 26 and a shroud 28 held between the first tray 24 and the second tray 26. First tray 24 and second tray 26 have an identical shape and function as the bottom and top of container 22 respectively. Container 22 also includes a plurality of dividers 30. Layers 31 of containers 22 are arranged on a pallet 32. When the second container 33 is placed on top of the first container 29, the second tray 26 of the first container 29 functions as the first tray 24 of the second container 33 as detailed below. Container assembly 20 also includes a top cap 34 that covers the layer 31 on the top as shown in FIG. 1.

Figure 2A:
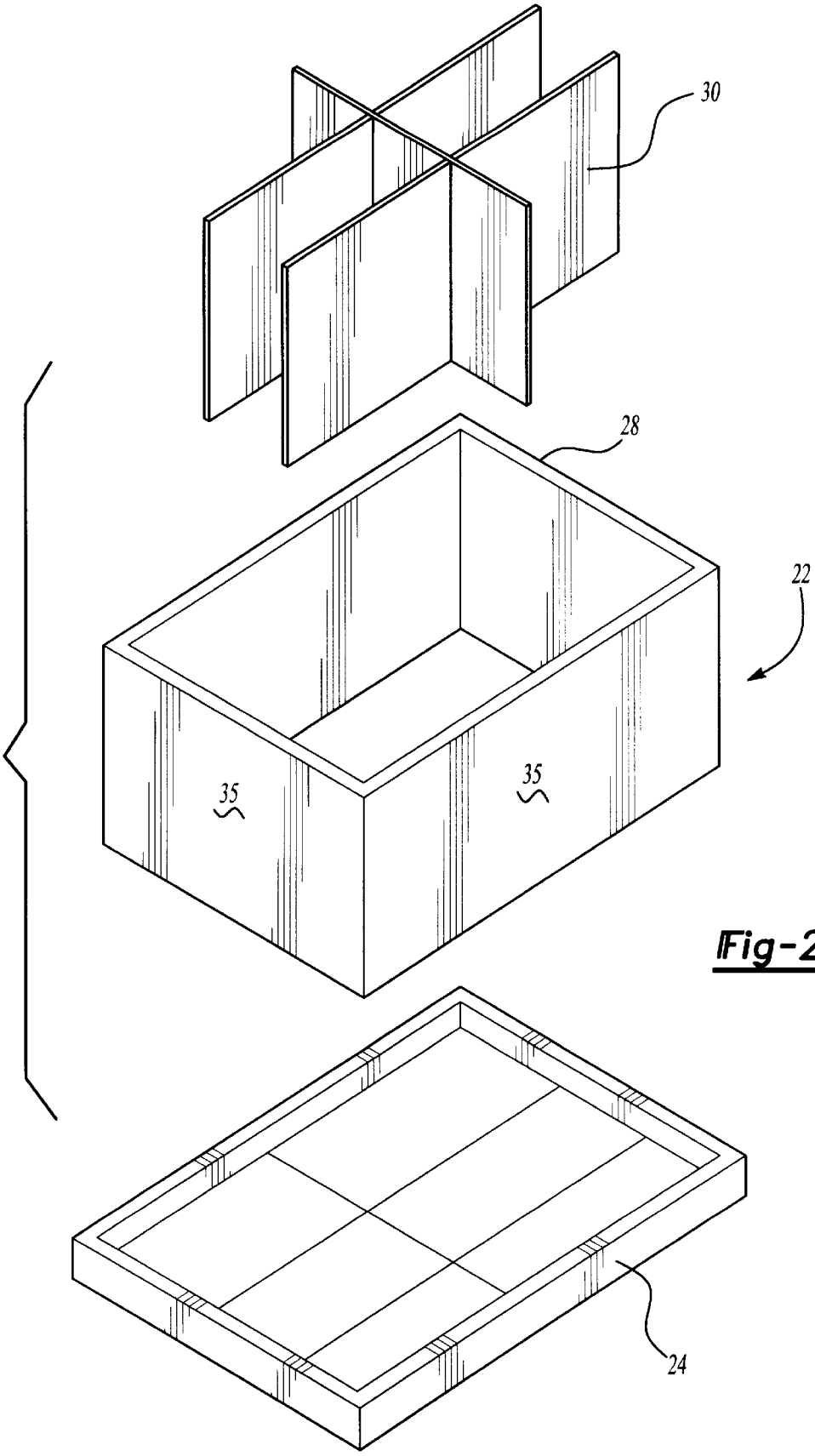
FIG. 2A is an exploded view of a container designed according to the present invention.

FIG. 2A is an exploded view of container 22 without second tray 26. Shroud 28 has four sides 35 and an open top and bottom. Preferably, shroud 28 is designed to collapse flat when it is not located in tray 24 as is known in the art. Thus, shroud 28 is preferably movable between a shipping configuration as shown in FIGS. 1—3 and a compact, collapsed configuration for storage and reuse. Shroud 28 preferably is made from corrugated paper, corrugated plastic or plastic sheet. Dividers 30 preferably interlock with each other and can be made from corrugated paper, corrugated plastic or plastic sheet as is known in the art. Dividers 30 can be of any number or shape as is known in the art. Preferably, dividers 30 are designed to collapse flat when they are not located in shroud 28 in a shipping configuration as is known in the art.

Dividers 30 may be integrated with shroud 28 in a manner that permits shroud 28 and divider 30 to open and close in an accordion fashion as is known in the art. Shroud 28 may be designed and fabricated to specific application strength and durability requirements as is known in the art.

Figure 2B:
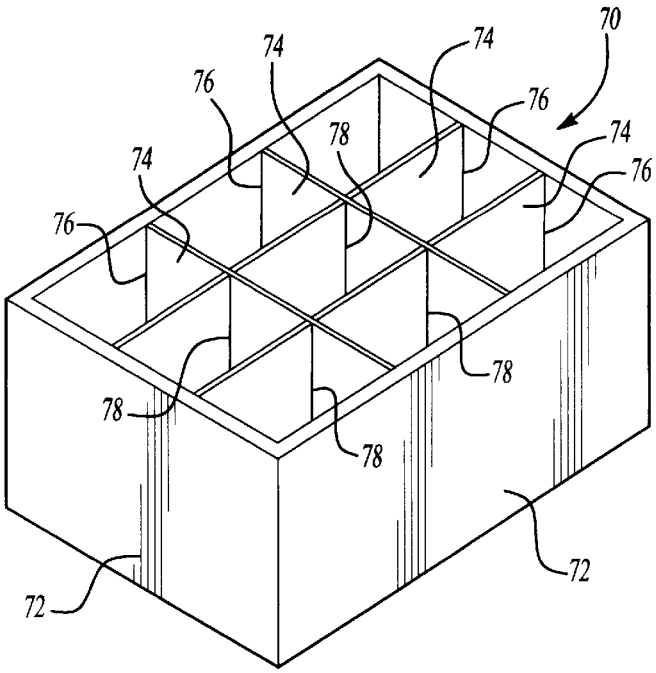
FIG. 2B is a perspective view of an embodiment of a combination shroud and dividers designed according to the present invention.
Figure 3:
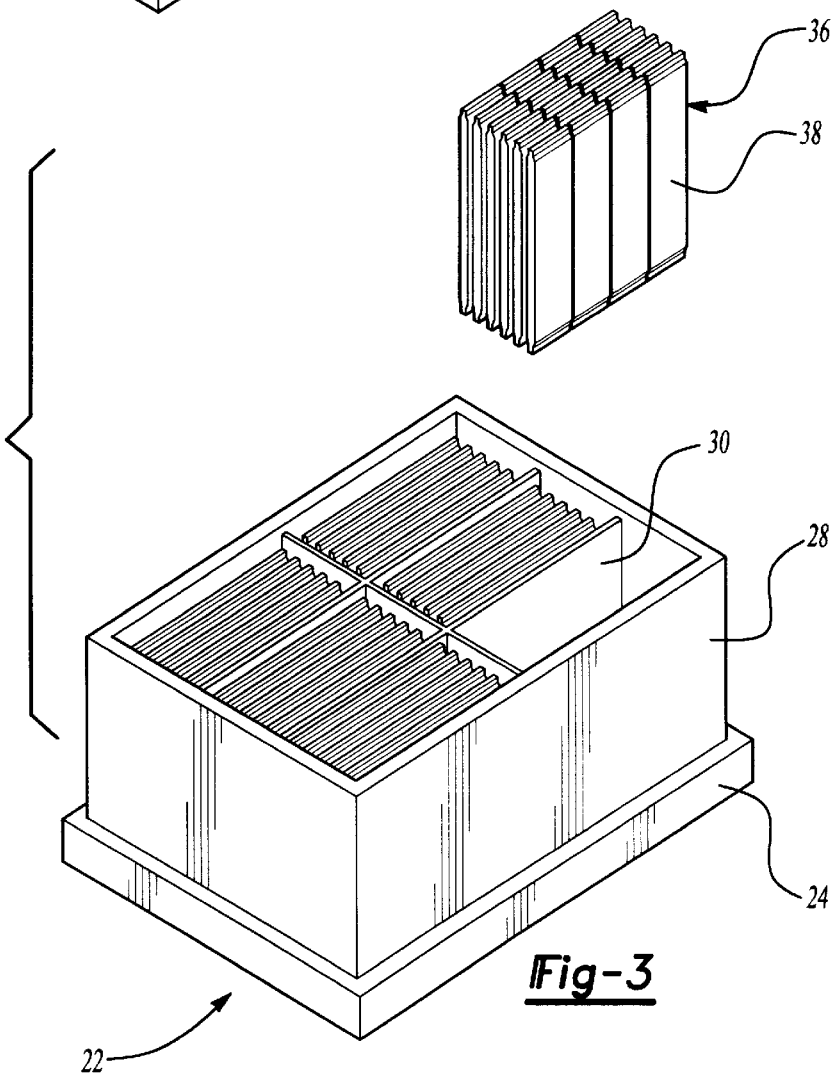
FIG. 3 is a side view of the container having a plurality of goods in it.

In FIG. 2B a perspective view of a combination shroud and dividers is generally shown at 70. The combination shroud and dividers 70 includes an outer shroud wall 72 that surrounds a plurality of dividers 74. Each divider 74 includes a pair of ends 76 that are secured to the outer shroud wall 72. The dividers 74 meet at a plurality of intersections 78. The dividers 74 can be adhered to each other at the intersections 78 or the intersections 78 may be formed by interlocking partial slits in each divider 74 as is known in the art. Preferably, the combination shroud and dividers 70 is collapsible, for example, an accordion type collapsing structure as is known in the art, when not mated to a first tray 24 or a second tray 26.

FIG. 3 is a side view of container 22 with a plurality of goods 36 in the spaces between dividers 30. Goods 36 include a primary wrap 38 as is known in the art. Container 22 could also be loaded with goods 36 having primary wrap 38 that have previously been placed in secondary packages such as, for example, cartons (not shown) as is known in the art. Container 22 can be used to hold a wide variety of goods, for example, pre-packaged foods, bulk components, and mixed goods. Goods 36 within a given container 22 may be similar or dissimilar goods.

Figure 4A:
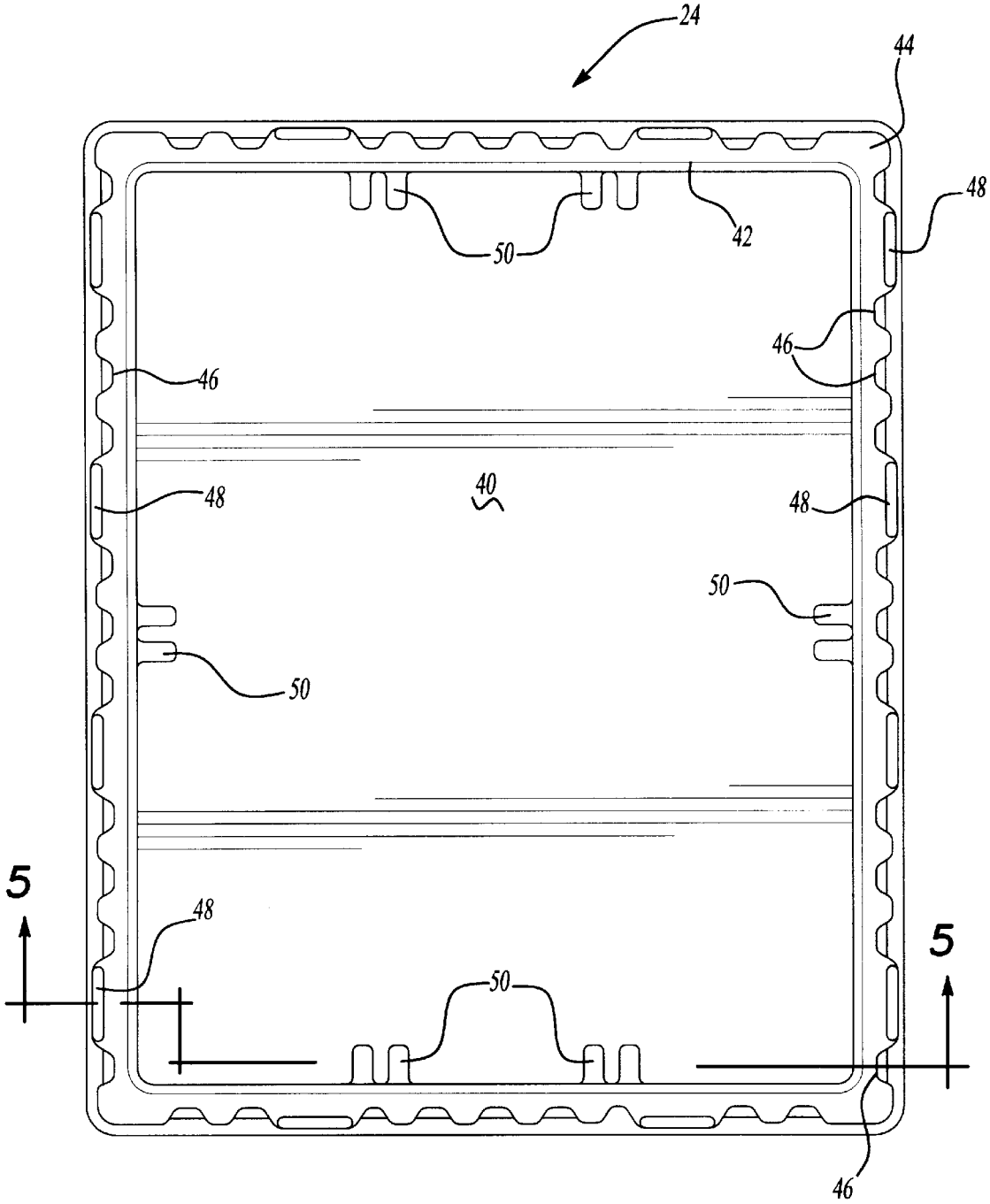
FIG. 4A is a top view of a first embodiment of a tray designed according to the present invention.
Figure 4B:
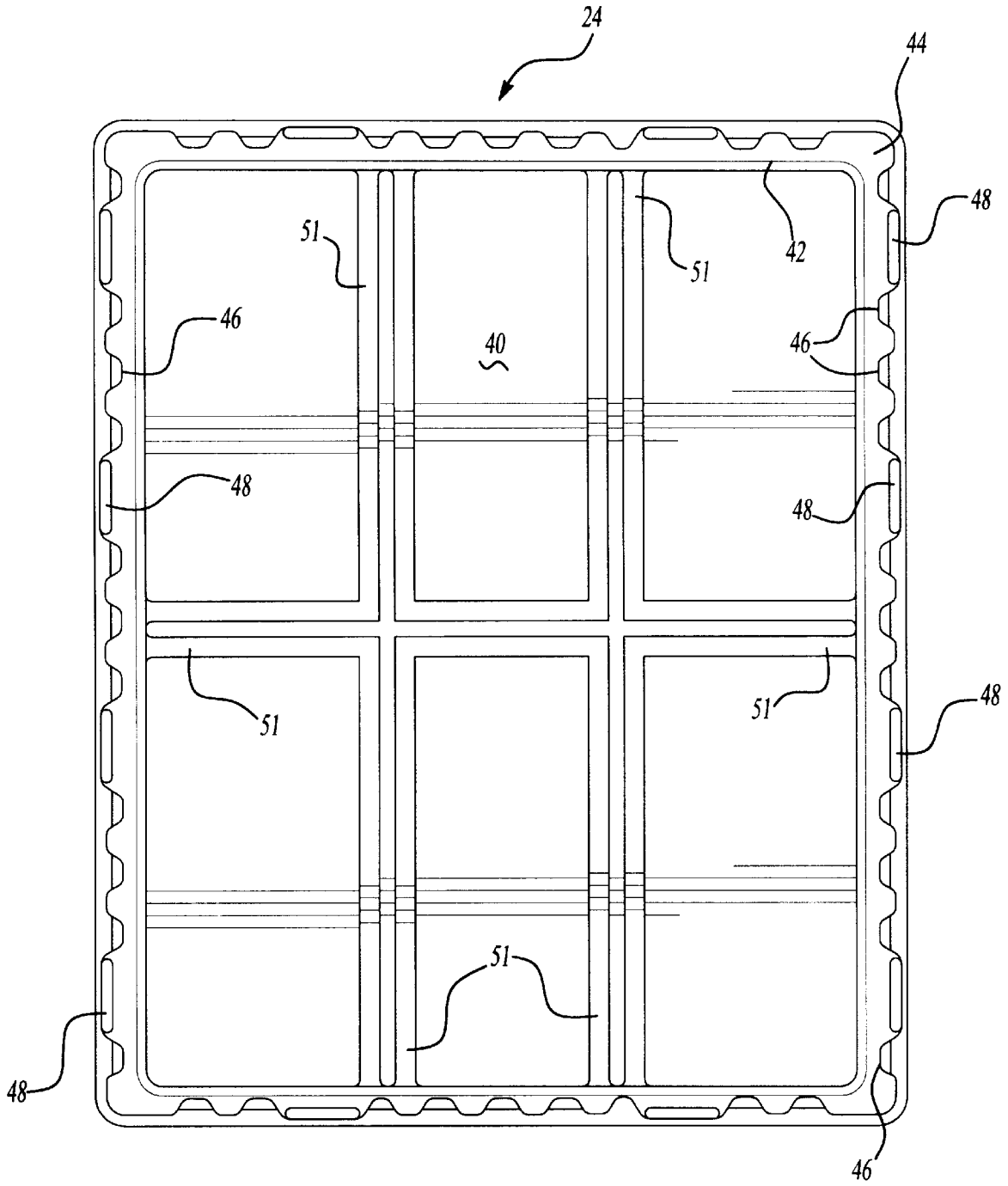
FIG. 4B is a top view of another embodiment of a tray designed according to the present invention.

FIG. 4A is a top view of first tray 24 and FIG. 4B is a top view of another embodiment of first tray 24, described below. As noted above first tray 24 and second tray 26 have an identical shape, thus only first tray 24 will be described below. Tray 24 includes a first surface 40 surrounded by a raised peripheral rim 42. An outer wall 44 is mounted on peripheral rim 42. Outer wall 44 is preferably L-shaped. Outer wall 44 includes a plurality of inwardly projecting ribs 46, which form a first locating feature. A plurality of tabs 48 extend downwardly from outer wall 44 and form a second locating feature. Tabs 48 are preferably located between ribs 46 as is shown. A plurality of pairs of retaining members 50 project upwardly from first surface 40. Retaining members 50 are designed to hold dividers 30 in place on first surface 40. As shown in FIG. 4B, first tray 24 may include retaining members 51 that are extended fully across first surface 40 if desired to hold dividers 30. The embodiment of first tray 24 shown in FIG. 4B is identical to that shown in FIG. 4A other than the length of retaining members 51, thus the same reference numerals are used in FIG. 4B.

First tray 24 is preferably of a unitary integral design and made of a plastic, for example, a polystyrene or a polyethylene. First tray 24 may be formed by a thermoforming method or by injection molding as is known in the art. When greater strength is required, for example, when shipping goods 36 overseas first tray 24 is preferably formed from a stronger plastic such as polyethylene. When less strength is required, for example, when storing goods 36 in a warehouse first tray 24 is preferably formed from a weaker plastic such as polystyrene.

FIG. 5 is a partial cross-sectional view along line 5—5 of FIGS. 4A and B. First tray 24 includes a second surface 52 opposite first surface 40.

FIG. 6 is an enlarged view of circle A from FIG. 5 showing rib 46. Peripheral rim 42 includes a inner surface 54 and an outer surface 56 opposite inner surface 54. Rib 46 includes an upward facing ramped portion 58. A side 35 of shroud 28 is located adjacent first surface 40 and is against rib 46 when shroud 28 is located in tray 24 as shown in FIG. 3. FIG. 6 also shows a second shroud 28 located adjacent second surface 52 and below outer wall 44 as it would be located when second container 33 is stacked on first container 29. Ramped portion 58 makes it easier to assemble container 22, especially when the assembly is performed by a machine (not shown) as is known in the art.

FIG. 7 is an enlarged view of circle B from FIG. 5 showing tab 48. A notch 60 is formed between tab 48 and outer surface 56. A side 35 of shroud 28 is accommodated in notch 60. Notch 60 prevents shroud 28 from separating from tray 24 when a load is placed on container 22 as container 22 is loaded in layers 31. As noted above with regard to FIG. 6, a side 35 of shroud 28 is located adjacent first surface 40 when shroud 28 is located in tray 24 as shown in FIG. 3. FIG. 7 also shows a second shroud 28 located adjacent second surface 52 in notch 60 as it would be located when second container 33 is stacked on first container 29.

FIG. 8 is an enlarged view of circle C from FIG. 5 showing retaining members 50. Retaining members 50 form a slot 60 to accommodate divider 30. Preferably, slot 60 has a partially V-shape for ease of insertion of dividers 30, especially by an automated procedure. FIG. 9 shows insertion of a divider 30 between a pair of retaining members 5O.

Figure 10:
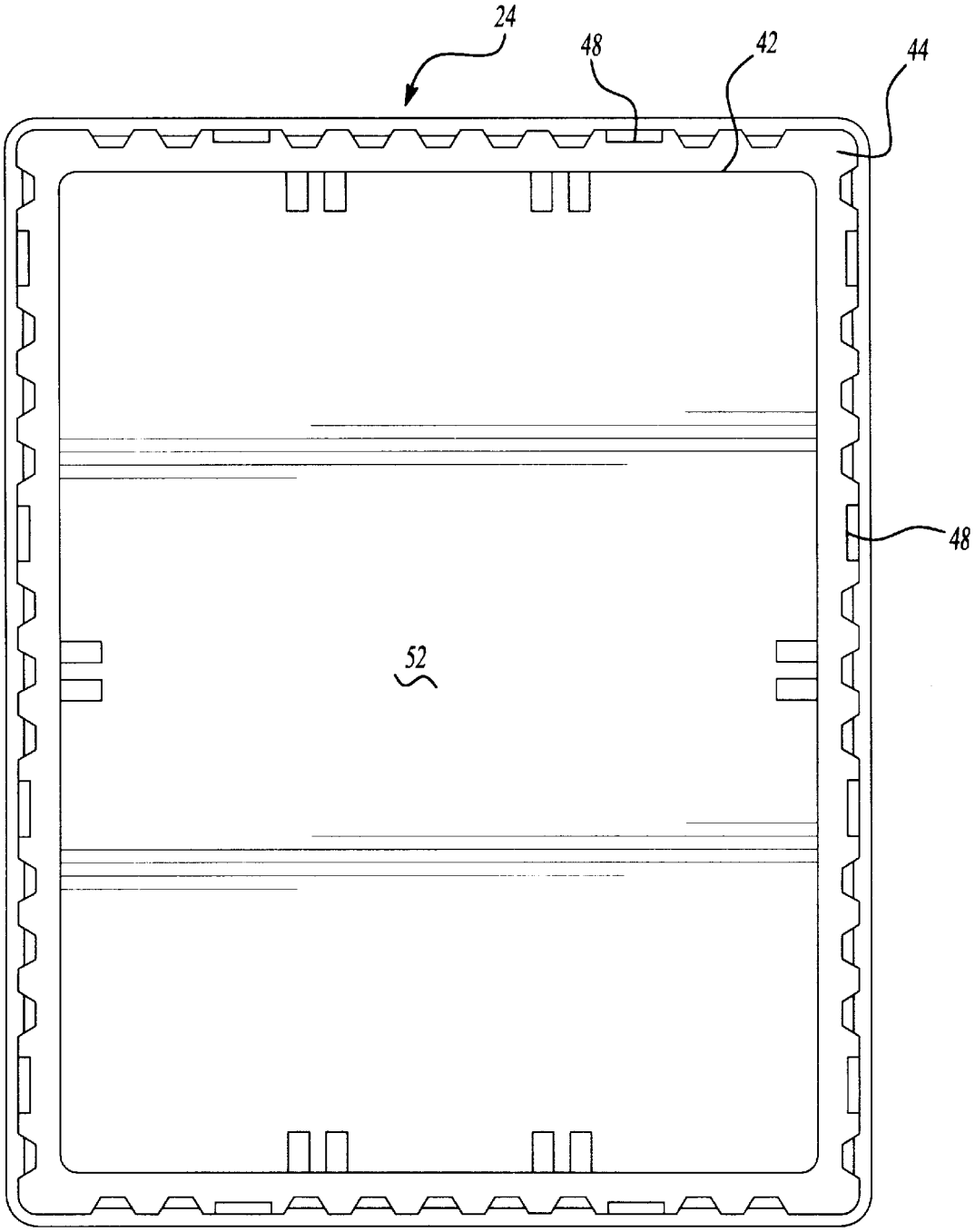
FIG. 10 is a bottom view of the tray shown in FIG. 4A.

FIG. 10 is a bottom view of tray 24. The shape of tray 24 permits a single tray 24 to function as a top for the first container 29 and a bottom for second container 33 as shown in FIGS. 1, 6 and 7. In addition, tray 24 can be inverted on the top layer 31 so that it serves as a top only. In this situation the first surface 40 of each tray 24 in each container 22 on the top layer 31 faces each other.

The present invention provides a packaging system that has a reduced number of components, thus shipping weight is reduced. A tray 24 designed according to the present invention has a high strength permitting the system to be reused. Likewise, divider 30 and shroud 28 can be reused and collapsed for return shipping. The versatility of the divider 30 permits container 22 to be used to hold a variety of goods 36.

The present invention has been described in accordance with the relevant legal standards, thus the foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

I claim:

1. A container assembly which utilizes interchangeable trays for shipping goods, said assembly comprising:

a plurality of containers including a first container and a second container;

said first container including a first tray, a second tray and a first shroud, said first shroud located between said first tray and said second tray;

said second container including a second shroud and a third tray, said second container stacked on top of said first container and said second shroud located between said third tray and said second tray; and each of said trays having an identical shape and including first and second opposing surfaces having first and second locating features respectively for retaining said shrouds, said first locating feature comprising a raised peripheral rim extending from said first surface and an outer wall mounted on said raised peripheral rim, with said shroud disposed within said outer wall and adjacent to said outer wall, said outer wall further including a plurality of inwardly projecting ribs in abutting relationship to said shroud for retaining said shroud, said ribs having a ramped portion for guiding said shroud within said outer wall, said first shroud retained by said first locating feature of said first tray and said second locating feature of said second tray, said second shroud retained by said first locating feature of said second tray and either of said first and said second locating feature of said third tray.

2. The assembly as set forth in claim 1, wherein said second locating feature comprises a plurality of downwardly projecting tabs depending from said outer wall, a plurality of notches formed between said downwardly projecting tabs and said raised peripheral rim for retaining said shroud.

3. The assembly as set forth in claim 1, wherein said shrouds are movable between a shipping configuration and a compact configuration for storage and return shipment of said shrouds.

4. The assembly as set forth in claim 1, wherein said shrouds comprise corrugated cardboard.

5. The assembly as set forth in claim 1, wherein said shrouds comprise plastic.

6. The assembly as set forth in claim 1 further comprising a plurality of dividers disposed within at least one of said shrouds and arranged into a shipping configuration to form a plurality of compartments adapted to store the goods.

7. The assembly as set forth in claim 6, wherein each of said first opposing surfaces further include at least one pair of retaining members, said pair of retaining members forming a slot for retaining at least a portion of said dividers.

8. The assembly as set forth in claim 6, wherein said dividers are movable between said shipping configuration and a compact configuration for storage and return shipment of said dividers.

9. The assembly as set forth in claim 6, wherein said dividers comprise corrugated cardboard.

10. The assembly as set forth in claim 6, wherein said dividers comprise plastic.

11. The assembly as set forth in claim 6, wherein said dividers are attached to at least one of said shrouds to form a unitary structure.

12. The assembly as set forth in claim 6, wherein at least one of said dividers is arranged transversely to at least another of said dividers thus forming an intersection, said at least one and at least another of said dividers interlocking together at said intersection.

13. The assembly as set forth in claim 6, wherein said dividers are disposed within said first shroud, said dividers supported by said first surface of said first tray and abutting said second surface of said second tray for supporting said second tray.

14. A plastic tray for a packaging system utilizing shrouds and dividers, said tray comprising:

first and second opposing surfaces;

a raised peripheral rim extending from said first surface and an outer wall mounted on said raised peripheral rim and adapted to retain one of the shrouds, said outer wall including a plurality of inwardly projecting ribs having a ramped portion adapted to guide the one of the shrouds within said outer wall;

a plurality of downwardly projecting tabs depending from said outer wall with a plurality of notches formed between said tabs and said raised peripheral rim adapted to retain another of the shrouds; and at least one pair of retaining members on said first surface forming a slot adapted to retain at least a portion of the dividers.

15. The tray as set forth in claim 14, wherein said tray comprises plastic.

16. The tray as set forth in claim 15, wherein said plastic comprises polystyrene.

17. The tray as set forth in claim 15, wherein said plastic comprises polyethylene.

* * * * *